US006592131B1

(12) United States Patent
Bai

(10) Patent No.: US 6,592,131 B1
(45) Date of Patent: Jul. 15, 2003

(54) IN-LINE ROLLER SKATE HAVING SOLID CUSHIONING DEVICE

(76) Inventor: Yio Deng Bai, 7F, No. 46, Pin Ho 10 Street, Chang Hua (TW), 500

( * ) Notice: Subject to any disclaimer, the term of this patent is extended or adjusted under 35 U.S.C. 154(b) by 0 days.

(21) Appl. No.: 10/117,273

(22) Filed: Apr. 4, 2002

(51) Int. Cl.[7] ..... A63C 17/08
(52) U.S. Cl. ..... 280/11.224; 280/11.225
(58) Field of Search ..... 280/11.225, 11.221, 280/11.223, 11, 231, 11.233, 11.27, 11.28, 11.19, 11.224

(56) References Cited

U.S. PATENT DOCUMENTS 5,533,740 A * 7/1996 Lin ..... 280/11.233
5,549,310 A * 8/1996 Meilbock et al. ..... 280/11.221
5,586,774 A * 12/1996 Dentale ..... 280/11.225
5,842,706 A 12/1998 Chang ..... 280/11.28
5,915,703 A * 6/1999 Wrike ..... 280/11.231
6,045,144 A * 4/2000 Wong ..... 280/11.231 X
6,053,512 A * 4/2000 Chang ..... 280/11.28
6,325,394 B1 * 12/2001 Svensson et al. ..... 280/11.224
6,450,508 B1 * 9/2002 Chu ..... 280/11.231 X

* cited by examiner

*Primary Examiner*—Brian L. Johnson
*Assistant Examiner*—Bryan Fischmann

(57) ABSTRACT

A roller skate includes a wheel housing having two front and two rear panels each of which has one or more oblong holes. Two seats are secured to a shoe, and each has two plates slidably engaged onto the panels with one or more conduits or tubes which are slidably received in the oblong holes of the panels for preventing the seats from moving laterally relative to the panels. A barrel is disposed on the wheel housing, a sleeve is disposed on the rear seat and slidably engaged onto the barrel, and a spring member is stably received between the sleeve and the barrel.

6 Claims, 3 Drawing Sheets

IN-LINE ROLLER SKATE HAVING SOLID CUSHIONING DEVICE

BACKGROUND OF THE INVENTION

1. Field of the Invention

The present invention relates to a roller skate, and more particularly to an in-line roller skate including a solid cushioning device.

2. Description of the Prior Art

Typical roller skates, such as the in-line roller skates, comprise a shoe attached onto a wheel housing, and one or more cushioning devices disposed between the shoe and the wheel housing for cushioning purposes. U.S. Pat. No. 5,842,706 to Chang discloses one of the in-line roller skates including a compressed spring member disposed in a guiding post. However, the guide post may not be stably guided to move relative to the wheel housing and may be stricken onto the wheel housing. Particularly, while skating, various kinds of large or great forces may be applied onto the wheel housing and the shoe, such that the guide post may have a good chance to be stricken onto the wheel housing and may thus be easily damaged after use. The spring member may be disengaged from the guide post, and the whole in-line roller skate has to be discarded when the spring member may no longer be solidly and stably retained in the guide post.

The present invention has arisen to mitigate and/or obviate the afore-described disadvantages of the conventional in-line roller skates.

SUMMARY OF THE INVENTION

The primary objective of the present invention is to provide a roller skate including a solid cushioning device for stably and solidly cushioning the shoe and for preventing the spring members from being disengaged from the wheel housing and/or the shoe.

In accordance with one aspect of the invention, there is provided a roller skate comprising a wheel housing including a plurality of wheels attached to bottom and including a front pair of panels and a rear pair of panels each having one or more pairs of oblong holes formed therein, a shoe including a front portion and a rear portion, a first seat secured to the front portion of the shoe and including a pair of plates extended downward therefrom and slidably engaged onto the front pair of panels for preventing the first seat from moving laterally relative to the front pair of panels, the plates of the first seat being rotatably secured to the front pair of panels with a conduit, a second seat secured to the rear portion of the shoe and including a pair of plates extended downward therefrom and slidably engaged onto the rear pair of panels for preventing the second seat from moving laterally relative to the rear pair of panels, a pair of tubes secured between the plates of the second seat and slidably engaged in the oblong holes of the rear pair of panels, for preventing the second seat from moving forward and rearward relative to the rear pair of panels, a barrel provided on the wheel housing and disposed between the rear pair of panels, a sleeve provided on the second seat and disposed between the plates of the second seat, and slidably engaged onto the barrel, for guiding the second seat to move up and down relative to the wheel housing, and for preventing the second seat from moving forward and rearward and sidewise relative to the rear pair of panels, and a cushioning member engaged between the barrel and the sleeve for cushioning the shoe.

The cushioning member is a coil spring or may be the other cushioning member, such as a resilient pad.

The front pair of panels each includes an oblong hole formed therein for slidably receiving the conduit.

The wheel housing includes a first pipe secured between the front pair of panels with a fastener device, and at least two second pipes secured between the rear pair of panels with fasteners.

The wheel housing includes an upper wall, the front and the rear pairs of panels are extended upward from the upper wall of the wheel housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
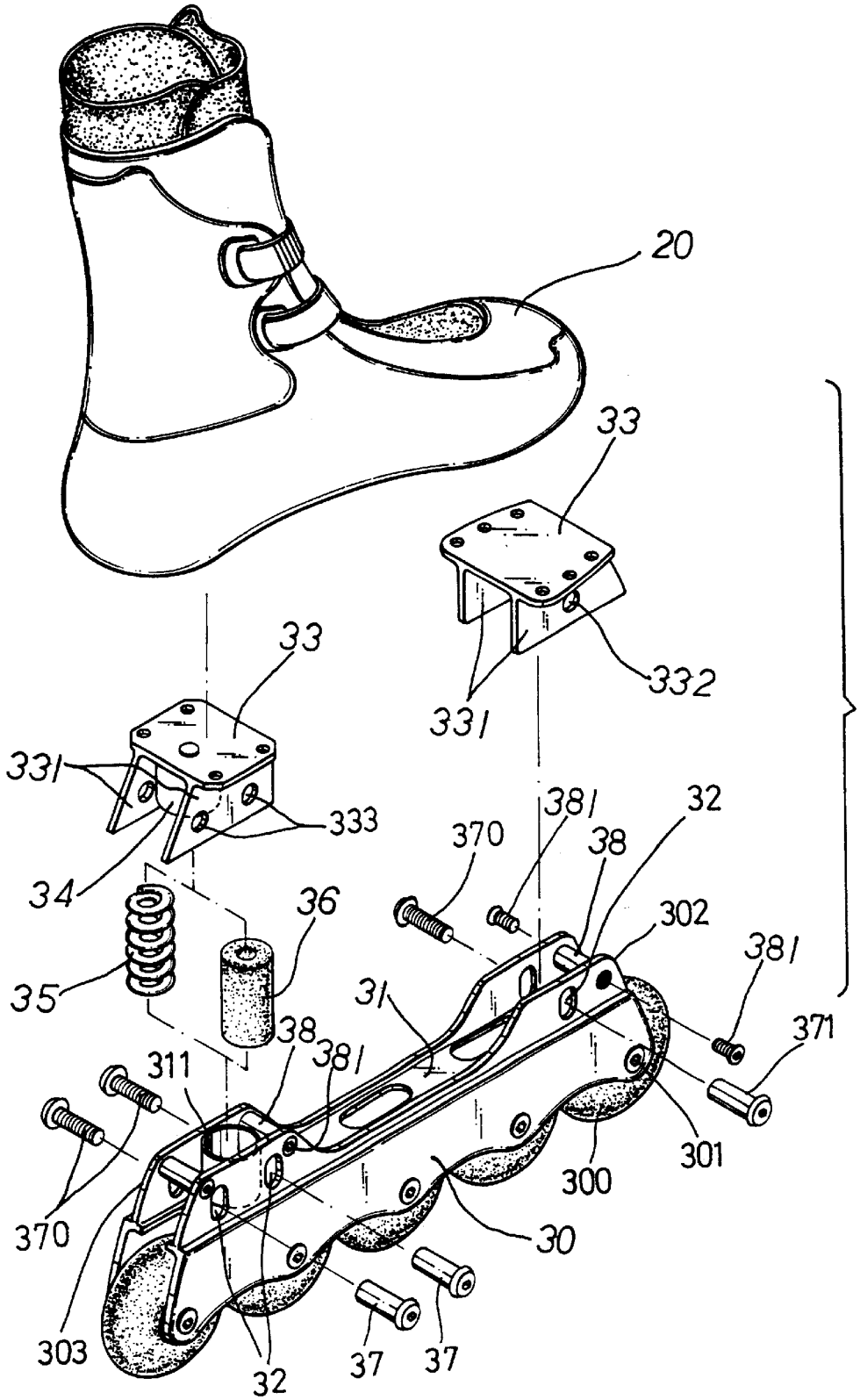
FIG. 1 is a partial exploded view of a roller skate in accordance with the present invention.
Figure 2:
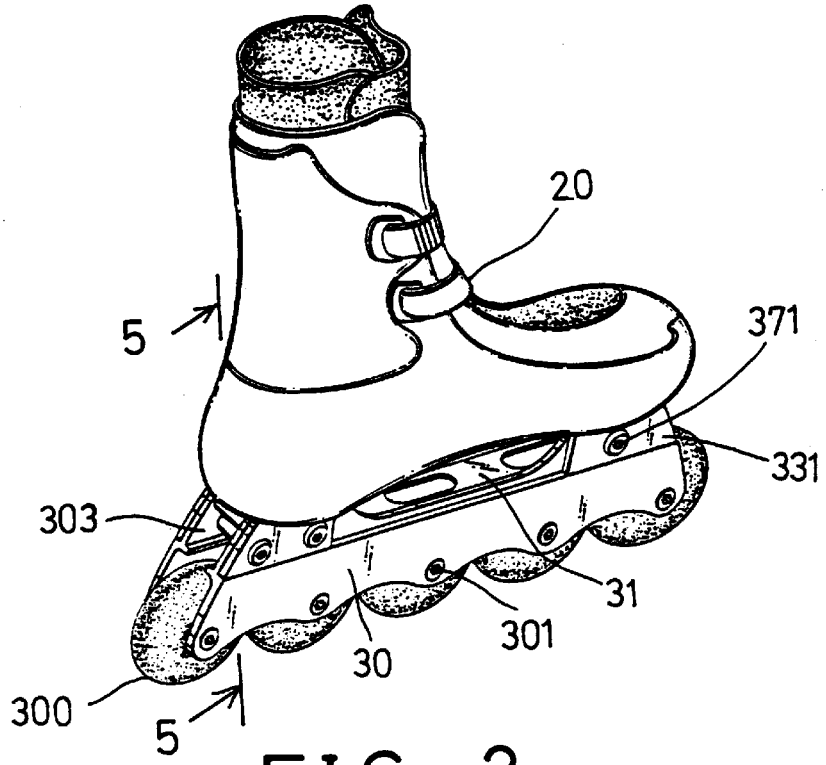
FIG. 2 is a perspective view of the roller skate.
Figure 3:
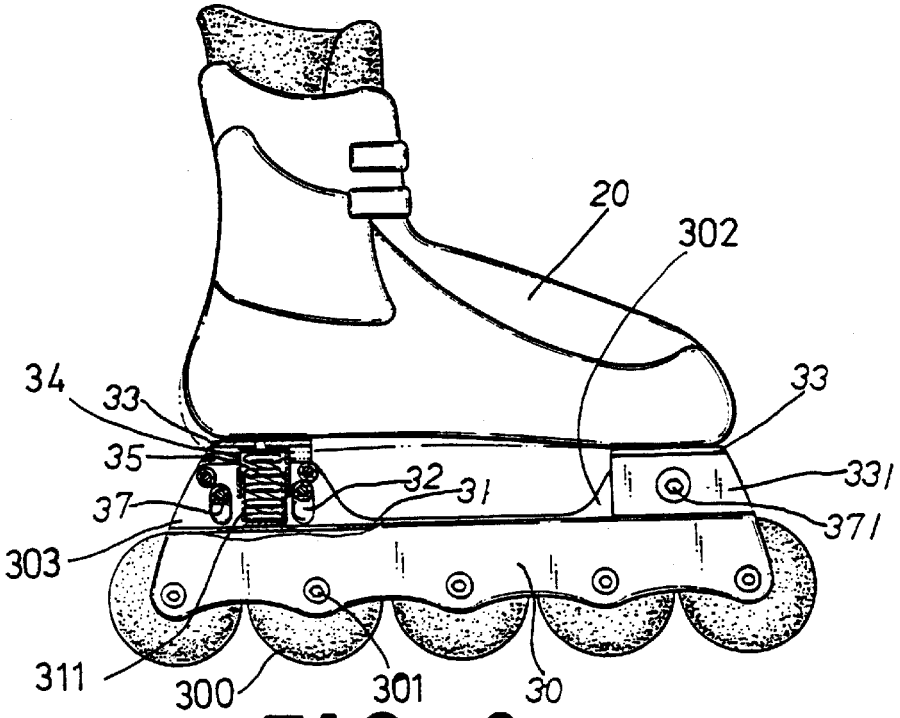
FIG. 3 is a side view of the roller skate, in which a portion of the roller skate has been cut off for showing the inner structure of the roller skate.

Referring to the drawings, and initially to FIGS. 1–3, a roller skate in accordance with the present invention, such as an in-line roller skate comprises a wheel housing 30 including one or more wheels 300 rotatably attached to the bottom with pivot spindles 301 respectively, and including an upper wall 31 provided on the upper portion thereof, and including a front pair and a rear pair of panels 302, 303 extended upward from the front and the rear portions thereof, and including one or more pipes 38 secured between the pairs of panels 302, 303 respectively with fasteners 381, for example, for solidly securing the panels 302, 303 together, and for preventing the panels 302, 303 from moving away or toward each other.

The front pair of panels 302 each includes an oblong hole 32 formed therein for slidably receiving a conduit 371 therein each, and the rear pair of panels 303 each includes two or more oblong holes 32 formed therein for slidably receiving a tube 37 therein each. The conduit 371 and the tubes 37 may be secured to the panels 302, 303 with fasteners 370. The wheel housing 30 includes a barrel 311 provided on the rear portion thereof and disposed between the pair of rear panels 303, for receiving a spring member or a cushioning member, such as a coil spring 35 (FIG. 3) or a resilient or rubber pad 36 (FIG. 4) therein. Alternatively, the front panels 302 may each include a circular hole 32 formed therein for rotatably receiving the conduit 371.

Two seats 33 are provided above the pairs of panels 302, 303, and secured to the bottom of the front and the rear portions of a shoe 20 such as with fasteners, and each includes a pair of plates 331 extended downward therefrom and slidably engaged onto the outer portion of the pairs of panels 302, 303 respectively for guiding the seats 33 to move upward and downward relative to the pairs of panels 302, 303 or the wheel housing 30 respectively, and for preventing the seats 33 from moving sidewise relative to the panels 302, 303 or the wheel housing 30.

The plates 331 of the front seat 33 each include an orifice 332 formed therein for receiving the conduit 371, and the plates 331 of the rear seat 33 each include an aperture 333 formed therein for receiving the tubes 37 respectively, such that the conduit 371 and the tubes 37 may further be used to limit the sliding movement of the seats 33 relative to the panels 302, 303 and/or the wheel housing 30, and to limit the seats 33 to move upward and downward relative to the panels 302, 303 and/or the wheel housing 30 only. The rear seat 33 includes a sleeve 34 extended downward therefrom and disposed between the plates 331 thereof, for slidably engaging onto the barrel 311 of the wheel housing 30, and for further stably guiding the sleeve 34 and thus the seat 33 to move upward and downward relative to the panels 302, 303 and/or the wheel housing 30.

Figure 4:
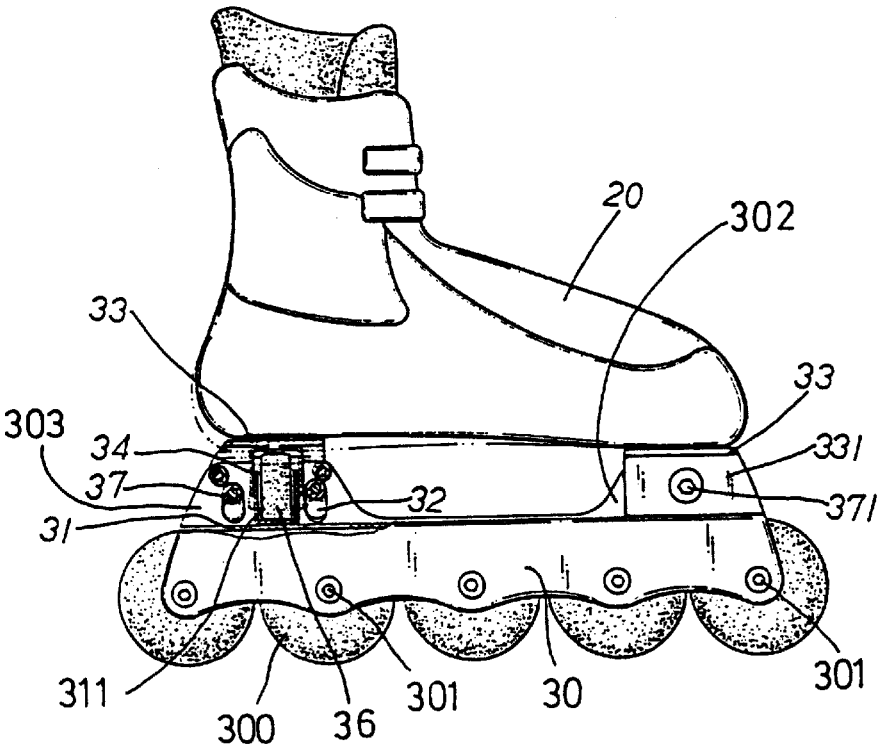
FIG. 4 is a side view of the roller skate, similar to FIG. 3, illustrating the other arrangement of the roller skate, in which a portion of the roller skate has been cut off for showing the inner structure of the roller skate.
Figure 5:
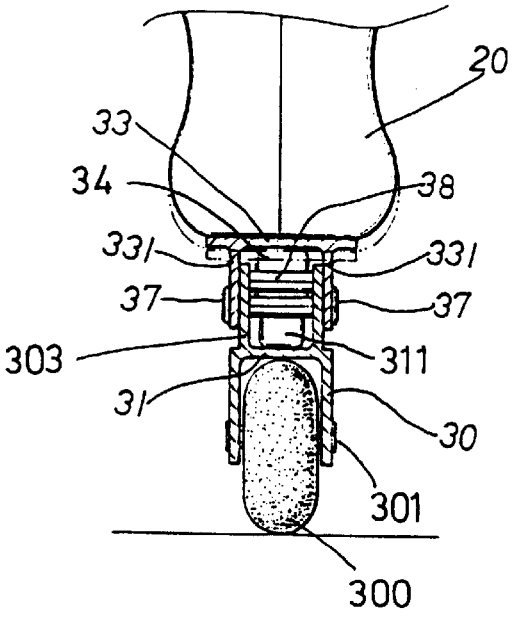
FIG. 5 is a partial cross sectional view taken along lines 5—5 of FIG. 2.

In operation, as shown in FIGS. 3–5, the sliding engagement of the sleeve 34 onto the barrel 311 may stably guiding the sleeve 34 and thus the seat 33 and the shoe 20 to move upward and downward relative to the panels 302, 303 and/or the wheel housing 30. The sliding engagement of the plates 331 of the seats 33 onto the panels 302, 303 of the wheel housing 30 may further stably guide the seat 33 and the shoe 20 to move upward and downward relative to the panels 302, 303 and/or the wheel housing 30, and may prevent the seat 33 and the shoe 20 from moving sidewise relative to the panels 302, 303 and/or the wheel housing 30.

In addition, the sliding engagement of the tubes 37 and/or the conduit 371 in the oblong holes 32 of the panels 302, 303 of the wheel housing 30 may further stably guide the seat 33 and the shoe 20 to move upward and downward relative to the panels 302, 303 and/or the wheel housing 30, and may prevent the seat 33 and the shoe 20 from moving forward and rearward relative to the panels 302, 303 and/or the wheel housing 30. The shoe 20 may thus be solidly and stably and slidably secured to the wheel housing 30, with the cushioning member 35 or 36.

Accordingly, the roller skate in accordance with the present invention includes a solid cushioning device for stably and solidly cushioning the shoe and for preventing the spring members from being disengaged from the wheel housing and/or the shoe.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A roller skate comprising:

a wheel housing including a plurality of wheels attached to a bottom of said wheel housing, said wheel housing including a front pair of panels and a rear pair of panels extended upward therefrom, said rear pair of panels each including a pair of oblong holes formed therein, a shoe including a front portion and a rear portion, a first seat secured to said front portion of said shoe and including a pair of plates extended downward therefrom and slidably engaged onto said front pair of panels for preventing said first seat from moving laterally relative to said front pair of panels, said plates of said first seat being rotatably secured to said front pair of panels with a conduit, a second seat secured to said rear portion of said shoe and including a pair of plates extended downward therefrom and slidably engaged onto said rear pair of panels for preventing said second seat from moving laterally relative to said rear pair of panels, a pair of tubes secured between said plates of said second seat and slidably engaged in said oblong holes of said rear pair of panels, for preventing said second seat from moving forward and rearward relative to said rear pair of panels, a barrel provided on said wheel housing and disposed between said rear pair of panels, a sleeve provided on said second seat and disposed between said plates of said second seat, and slidably engaged onto said barrel, for guiding said second seat to move up and down relative to said wheel housing, and for preventing said second seat from moving forward and rearward and sidewise relative to said rear pair of panels, and a cushioning member engaged between said barrel and said sleeve for cushioning said shoe.

2. The roller skate according to claim 1, wherein said cushioning member is a coil spring.

3. The roller skate according to claim 1, wherein said cushioning member is a resilient pad.

4. The roller skate according to claim 1, wherein said front pair of panels each includes an oblong hole formed therein for slidably receiving said conduit.

5. The roller skate according to claim 1, wherein said wheel housing includes a first pipe secured between said front pair of panels with a fastener device, and at least two second pipes secured between said rear pair of panels with fasteners.

6. The roller skate according to claim 1, wherein said wheel housing includes an upper wall, said front and said rear pairs of panels are extended upward from said upper wall of said wheel housing.

* * * * *